US008757102B2

(12) United States Patent
Ookubo et al.

(10) Patent No.: US 8,757,102 B2
(45) Date of Patent: Jun. 24, 2014

(54) BOILER

(75) Inventors: Tomohiro Ookubo, Matsuyama (JP); Kyousuke Ookubo, Matsuyama (JP); Soji Sumi, Matsuyama (JP)

(73) Assignee: Miura Co., Ltd., Matsuyama-Shi, Ehime-Ken (JP)

( * ) Notice: Subject to any disclaimer, the term of this patent is extended or adjusted under 35 U.S.C. 154(b) by 350 days.

(21) Appl. No.: 12/081,182

(22) Filed: Apr. 11, 2008

(65) Prior Publication Data

US 2008/0257283 A1 Oct. 23, 2008

(30) Foreign Application Priority Data

Apr. 20, 2007 (JP) ..... 2007-112229

(51) Int. Cl.
*F22B 23/00* (2006.01)

(52) U.S. Cl.
USPC ..... 122/235.11; 122/367.3

(58) Field of Classification Search
USPC ..... 122/367.3, 235.11, 42, 130, 44.1, 49, 122/114, 6
See application file for complete search history.

(56) References Cited

U.S. PATENT DOCUMENTS 4,257,358 A * 3/1981 Watanabe ..... 122/235.11
5,791,299 A * 8/1998 Matsuo et al. ..... 122/367.1
6,269,782 B1 * 8/2001 Kayahara et al. ..... 122/235.11
6,823,821 B2 * 11/2004 Kayahara et al. ..... 122/367.1
7,827,941 B2 * 11/2010 Sumi ..... 122/235.11

FOREIGN PATENT DOCUMENTS

| | | | | | |
|---|---|---|---|---|---|
| CN | 1282848 | A | | 2/2001 | |
| JP | 62-155401 | A | | 7/1987 | |
| JP | 2-75805 | A | | 3/1990 | |
| JP | 6-221508 | A | | 8/1994 | |
| JP | 7-225055 | A | | 8/1995 | |
| JP | 2003-014204 | | * | 1/2003 | ..... F22B 37/02 |
| JP | 2003-14204 | A | | 1/2003 | |
| JP | 2003014204 | A | * | 1/2003 | ..... F22B 37/02 |
| JP | 2003014204 | A | * | 1/2003 | ..... F22B 37/02 |
| JP | 2004-225944 | A | | 8/2004 | |
| KR | 10-2003-0082196 | A | | 10/2003 | |
| KR | 10-2006-0076737 | A | | 7/2006 | |

* cited by examiner

*Primary Examiner* — Gregory A Wilson

(74) *Attorney, Agent, or Firm* — Birch, Stewart, Kolasch & Birch, LLP

(57) ABSTRACT

A boiler according to the present invention includes: a plurality of heat transfer tubes arranged to form a cylindrical shape between an upper header and a lower header to constitute a heat transfer tube row; a boiler body cover of a cylindrical shape provided between the upper header and the lower header so as to surround the heat transfer tube row; and a heat insulating material provided to a predetermined region of a space between the heat transfer tube row and the boiler body cover.

6 Claims, 5 Drawing Sheets

BOILER

BACKGROUND OF THE INVENTION

1. Field of the Invention

The present invention relates to various boilers including a steam boiler, a hot water boiler, a heat medium boiler, a waste heat boiler, and an exhaust gas boiler. In particular, the present invention relates to a multitubular boiler including a boiler body and longitudinal fins, the boiler body having a plurality of vertical heat transfer tubes arranged to form a cylindrical shape so as to connect an upper header to a lower header, the longitudinal fins being provided, in at least a part in a peripheral direction of the plurality of the vertical heat transfer tubes arranged to form the cylindrical shape, to gaps between the adjacent vertical heat transfer tubes.

The subject application claims a benefit of the priority of Japanese Patent Application No. 2007-112229 filed on Apr. 20, 2007, and contents thereof are herein incorporated.

2. Description of the Related Art

There are known as multitubular boilers ones disclosed in Japanese Patent Application Laid-open No. Hei 02-075805 (FIGS. 1 to 3) and Japanese Patent Application Laid-open No. 2004-225944. The boiler body of the boiler of this type includes the plurality of the water tubes between the upper header and the lower header each formed in an annular shape. The plurality of the water tubes are arranged in the peripheral direction of the upper header and the lower header so as to form a single row or two rows. In the boiler body including the above-mentioned water tube row, the inside of the inner water tube row is the combustion chamber, and an outside of the inner water tube row is the combustion gas flow path.

When the fuel is burned such that flame is generated from the burner installed in the upper portion of the boiler body toward the inside of the combustion chamber, a combustion gas is reversed in the lower portion of the combustion chamber and passes between the inner water tube row and the outer water tube row or between the outer water tube row and the boiler body cover to be discharged as an exhaust gas to the flue from the upper portion of the boiler body. In the meantime, the combustion gas undergoes heat exchange with water in each of the water tubes. As a result, water in the water tube is heated.

The boiler is normally controlled based on a pressure in the boiler body. Accordingly, temperature of water or steam in the boiler body becomes a saturation temperature at the control pressure, and temperature of the water tubes becomes close to the saturation temperature. On the other hand, the boiler body cover is exposed to the combustion gas or the exhaust gas of high temperature, so the temperature thereof is higher than the water tube temperature. Therefore, in a case where the water tubes and the boiler body cover are made of the same material, due to a temperature difference, there is generated a difference between a thermal expansion amount of the water tubes and a thermal expansion amount of the boiler body cover. As a result, thermal stress acts on the boiler body cover. That is, the thermal stress acts on the boiler body cover due to the temperature difference with respect to the water tubes.

SUMMARY OF THE INVENTION

An object of the present invention is to relax thermal stress acting on a boiler body cover by balancing thermal expansion of water tubes and thermal expansion of the boiler body cover.

According to a first aspect of the present invention, there is provided a boiler including: a plurality of heat transfer tubes arranged to form a cylindrical shape between an upper header and a lower header to constitute a heat transfer tube row; a boiler body cover of a cylindrical shape provided between the upper header and the lower header so as to surround the heat transfer tube row; and a heat insulating material provided to a predetermined region of a space between the heat transfer tube row and the boiler body cover.

In the boiler according to the first aspect of the present invention, a temperature of a region of the boiler body cover, where the heat insulating material is not provided, is higher than a heat transfer tube temperature (saturation temperature of heat medium at pressure in boiler body, and lower than combustion gas temperature) by a combustion gas or an exhaust gas. However, a region of the boiler body cover, where the heat insulating material is provided, is not exposed to the combustion gas or the exhaust gas, and heat transfer from the heat transfer tubes to the region is suppressed, so a temperature thereof is lower than the heat transfer tube temperature. Accordingly, while the region of the boiler body cover, where the heat insulating material is not provided (that is, high temperature portion), has a larger thermal expansion amount than that of the heat transfer tubes, the region of the boiler body cover, where the heat insulating material is provided (that is, low temperature portion), has a smaller thermal expansion amount than that of the heat transfer tubes. In this case, by adjusting a thickness and a height of the heat insulating material, expansion of the boiler body cover in the low temperature portion can be suppressed, thereby making the expansion of the entire boiler body cover the same as expansion of the heat transfer tubes. As a result, the thermal stress acting on the boiler body cover can be relaxed.

According to a second aspect of the present invention, there is provided a boiler including: a plurality of inner heat transfer tubes arranged to form a cylindrical shape between an upper header and a lower header to constitute an inner heat transfer tube row; a plurality of outer heat transfer tubes arranged to form a cylindrical shape between the upper header and the lower header so as to surround the inner heat transfer tube row to constitute an outer heat transfer tube row; a plurality of inner longitudinal fins provided to close gaps between the adjacent plurality of inner heat transfer tubes except at one end in a vertical direction of the inner heat transfer tube row; a plurality of outer longitudinal fins provided to close gaps between the adjacent plurality of outer heat transfer tubes except at another end in a vertical direction of the outer heat transfer tube row; a boiler body cover of a cylindrical shape provided between the upper header and the lower header so as to surround the outer heat transfer tube row; and a heat insulating material provided to a predetermined region of a space between the outer heat transfer tube row and the boiler body cover.

In the boiler according to the second aspect of the present invention, a temperature of a region of the boiler body cover, where the heat insulating material is not provided, is higher than a heat transfer tube temperature (saturation temperature of heat medium at pressure in boiler body, and lower than combustion gas temperature) by a combustion gas or an exhaust gas. However, a region of the boiler body cover, where the heat insulating material is provided, is not exposed to the combustion gas or the exhaust gas, and heat transfer from the heat transfer tubes to the region is suppressed, so a temperature thereof is lower than the heat transfer tube temperature. Accordingly, while the region of the boiler body cover, where the heat insulating material is not provided (that is, high temperature portion), has a larger thermal expansion amount than that of the heat transfer tubes, the region of the boiler body cover, where the heat insulating material is provided (that is, low temperature portion), has a smaller thermal expansion amount than that of the heat transfer tubes. In this case, by adjusting a thickness and a height of the heat insulating material, expansion of the boiler body cover in the low temperature portion can be suppressed, thereby making the expansion of the entire boiler body cover the same as expansion of the heat transfer tubes. As a result, the thermal stress acting on the boiler body cover can be relaxed.

In the boiler according to the second aspect of the present invention, the heat insulating material may be charged in one end side in a vertical direction of the heat transfer tube row.

In the boiler according to the second aspect of the present invention, the boiler body cover has a large diameter portion at the other end in the vertical direction of the heat transfer tube rows, and a casing may be provided so as to surround the boiler body cover. In this case, it is preferable that, through a space between the boiler body cover and the casing, combustion air be sent into a combustion chamber provided on an inner side of the inner heat transfer tube row.

In the boiler according to the second aspect of the present invention, by using the combustion air sent into the combustion chamber through the space between the boiler body cover and the casing, the boiler body cover can be actively cooled. As a result, the thickness of the heat insulating material is reduced, thereby making it possible to downsize the boiler. Further, by preheating the combustion air, thermal efficiency can be improved.

In the boiler according to the first aspect of the present invention, the boiler body cover may be provided with an expansion portion expandable in the vertical direction. The same can be applied to the boiler according to the second aspect of the present invention.

In the boiler according to the first aspect and the second aspect of the present invention, by expansion and contraction of the expansion portion provided to the boiler body cover, the thermal stress acting on the boiler body cover can be relaxed more reliably.

In the boiler according to the present invention, by balancing the thermal expansion of the heat transfer tubes and the thermal expansion of the boiler body cover, the thermal stress acting on the boiler body cover can be relaxed.

DETAILED DESCRIPTION OF THE PREFERRED EMBODIMENTS

Figure 1:
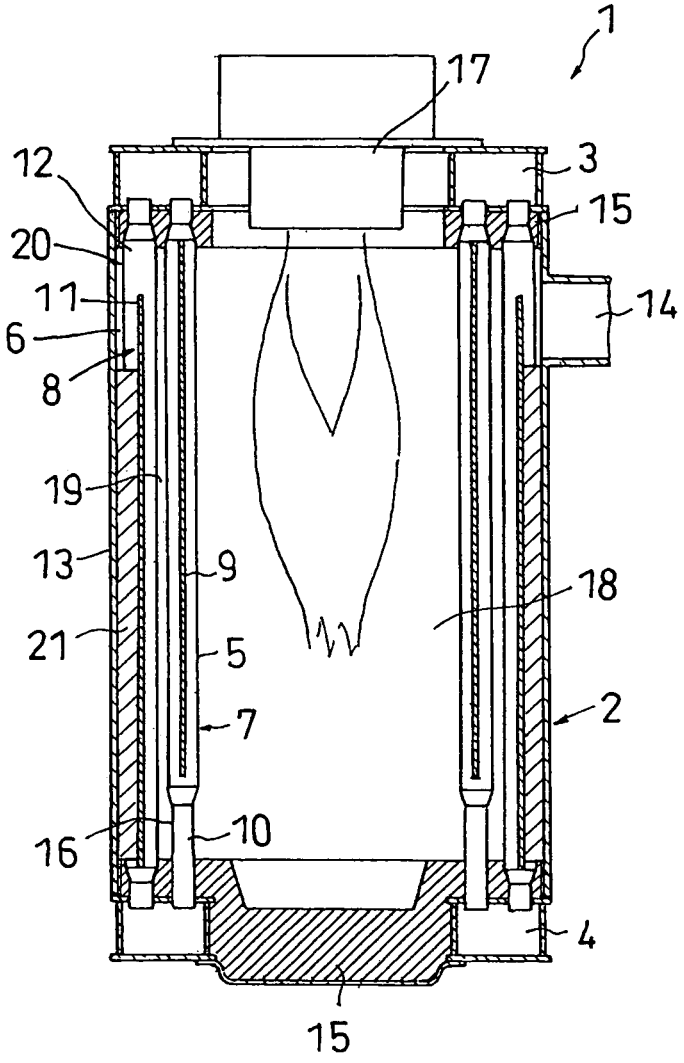
FIG. 1 is a schematic vertical sectional view showing a boiler according to Embodiment 1 of the present invention.

Next, embodiment modes of the present invention will be described.

A boiler according to the present invention is not limited to a certain type and is, for example, a steam boiler, a hot water boiler, a heat medium boiler, a waste heat boiler, or an exhaust gas boiler. In any case, the boiler is a multitubular boiler and is typically a multitubular small once-through boiler.

Specifically, the boiler includes an upper header, a lower header, and a boiler body including a plurality of heat transfer tubes connecting the upper header to the lower header. The upper header and the lower header are arranged at a vertical distance in parallel to each other. Each of the upper header and the lower header forms a hollow annular shape. All the plurality of the heat transfer tubes are vertically arranged and are disposed between the upper header and the lower header. That is, upper ends of the heat transfer tubes are connected to the upper header and lower ends thereof are connected to the lower header. The heat transfer tubes are arranged between the upper header and the lower header in a peripheral direction thereof, thereby constituting a heat transfer tube row of a cylindrical shape.

The heat transfer tube row is not limited to a single row, and may be two rows, three rows, or more. For example, the boiler body includes an inner heat transfer tube row and an outer heat transfer tube row. In this case, the inner heat transfer tube row includes a plurality of inner heat transfer tubes arranged to form a cylindrical shape between the upper header and the lower header. Further, the outer heat transfer tube row includes a plurality of outer heat transfer tubes arranged to form a cylindrical shape between the upper header and the lower header so as to surround the inner heat transfer tube row. In the above-mentioned case where there are provided the plurality of the heat transfer tube rows, the heat transfer tube rows are arranged in concentric cylindrical shapes.

The boiler body is normally closed at one end thereof in a vertical direction and has a burner at the other end thereof in the vertical direction. With this structure, an inside of the heat transfer tube row arranged on an innermost side constitutes a combustion chamber. It is possible to burn a fuel so that flame is generated from the burner toward the combustion chamber. Note that, in a case of the waste heat boiler or the exhaust gas boiler, the boiler body is closed at one end thereof in the vertical direction and has an opening portion at the other end thereof in the vertical direction, through which an exhaust gas is introduced into the boiler. That is, in the case of the waste heat boiler or the exhaust gas boiler, an exhaust gas is introduced into a space on an inner side of the heat transfer tube row arranged on the innermost side. In both cases, an outer peripheral portion of the boiler body is covered by a boiler body cover.

The boiler body cover is a cylindrical member provided between the upper header and the lower header so as to surround the heat transfer tube rows. An upper end of the boiler body cover and the upper header are hermetically sealed. A lower end of the boiler body cover and the lower header are also hermetically sealed. The boiler body cover is connected to a flue. A combustion gas from the combustion chamber (exhaust gas in the case of waste heat boiler or exhaust gas boiler) undergoes heat exchange with a heat carrier (such as water) flowing through each of the heat transfer tubes, and is then discharged from the flue as the exhaust gas.

In order to achieve effective heat exchange with a heat carrier flowing through the heat transfer tubes, the combustion gas flows through a space between the outer heat transfer tube row and the inner heat transfer tube row and a space between the outer heat transfer tube row and the boiler body cover through a predetermined passage. Alternatively, the combustion gas flows through one of the space between the outer heat transfer tube row and the inner heat transfer tube row, and the space between the heat transfer tube rows and the boiler body cover through the predetermined passage. In order to define the passage, a part or an entire portion of the heat transfer tube row may be provided with, except at an end in the vertical direction thereof or the other end in the vertical direction thereof, longitudinal fins provided to close gaps between the adjacent heat transfer tubes. In this case, the combustion gas flows through the gaps between the adjacent heat transfer tubes formed in a portion where the longitudinal fin is not provided.

For example, in the case where the boiler body includes the inner heat transfer tube row and the outer heat transfer tube row, the inner heat transfer tube row is provided with inner longitudinal fins except at one end in the vertical direction thereof such that the gaps between the adjacent inner heat transfer tubes are closed. Further, the outer heat transfer tube row is provided with outer longitudinal fins except at the other end in the vertical direction thereof such that the gaps between the adjacent outer heat transfer tubes are closed. An inside of the inner heat transfer tube row constitutes a combustion chamber.

In this case, the combustion gas from the combustion chamber is introduced through the gaps between the inner heat transfer tubes formed in a portion where the inner longitudinal fins are not provided at the one end in the vertical direction of the inner heat transfer tube row to a space between the inner heat transfer tube row and the outer heat transfer tube row. Further, at the other end in the vertical direction of the outer heat transfer tube row, through the gaps between the outer heat transfer tubes formed in the portion where the outer longitudinal fin is not provided, the combustion gas is introduced to a space between the outer heat transfer tube row and the boiler body cover. The exhaust gas is discharged to the outside through the flue connected to the boiler body cover.

In a case of the boiler body having a structure in which the combustion gas is discharged from an entire periphery of the one end in the vertical direction of the outer heat transfer tube row arranged on an outermost side or an entire periphery of the other end in the vertical direction thereof, it is necessary that the boiler body cover be provided to an entire periphery of an outer side of the outer heat transfer tube row. In this case, the exhaust gas flows through the flue via the boiler body cover to be discharged to the outside.

In the boiler body structured in this manner, the temperature of the heat transfer tubes is close to the saturation temperature of a medium (water, steam, or the like) at a pressure therein. However, the boiler body cover is exposed to the combustion gas whose temperature is higher, for example, by about 50 to 150° C. than the temperature of the heat transfer tubes. Accordingly, the temperature of the boiler body cover is higher than the temperature of the heat transfer tubes. Therefore, there is a problem in that thermal stress acts on the boiler body cover due to a temperature difference with respect to the heat transfer tube.

The thermal stress is relaxed merely by balancing thermal expansion of the heat transfer tubes and thermal expansion of the boiler body cover. In this case, in a predetermined region of the space between the outer heat transfer tube row and the boiler body cover, a heat insulating material is charged. A temperature of the boiler body cover adjacent to a region where the heat insulating material is not provided (that is, high temperature portion) is higher than the heat transfer tube temperature (almost equal to the saturation temperature of the heat medium at the pressure in the boiler body, and is lower than a combustion gas temperature) because the boiler body cover is heated by the combustion gas or the exhaust gas. However, the temperature of the boiler body cover adjacent to a region where the heat insulating material is provided (that is, low temperature portion) is lower than the heat transfer tube temperature because the boiler body cover is not directly exposed to the combustion gas or the exhaust gas and heat transfer from the heat transfer tubes is suppressed. In this case, by adjusting a thickness and a height of the heat insulating material charged in the space, expansion of the boiler body cover in the low temperature portion can be suppressed, thereby equalizing the expansion of the boiler body cover and expansion of the heat transfer tubes. As a result, the thermal stress caused in the boiler body cover can be relaxed.

In a case where the combustion gas is discharged from an upper outer peripheral portion of the outer heat transfer tube row, it suffices that the heat insulating material is charged in a lower region of the space between the outer heat transfer tube row and the boiler body cover. On the other hand, in a case where the combustion gas is discharged from a lower outer peripheral portion of the outer heat transfer tube row, it suffices that the heat insulating material is charged in an upper region of the space between the outer heat transfer tube row and the boiler body cover.

In order to more reliably relax the thermal stress caused in the boiler body cover, it is preferable that the boiler body cover be actively cooled by using combustion air sent to the combustion chamber thorough a space between the boiler body cover and a casing. Specifically, a large diameter portion is provided to a portion of the boiler body cover constituting the high temperature portion, and the casing may be provided so as to surround the boiler body cover. In this case, the combustion air is sent to the combustion chamber on the inner side of the inner heat transfer tube row through the space between the boiler body cover and the casing. In this manner, the boiler body cover can be cooled by air sucked into a blower or air ejected from the blower.

Further, when a part of the boiler body cover is provided with an expansion portion which is expandable, for example, an expansion portion of a bellows shape, the thermal stress acting on the boiler body cover can be relaxed more reliably.

Embodiment 1

Hereinafter, specific embodiments of the present invention will be described in detail with reference to the drawings.

FIG. 1 is a schematic vertical sectional view showing a boiler according to Embodiment 1 of the present invention. A boiler 1 of this embodiment is a multitubular small once-through boiler including a boiler body 2 of a cylindrical shape. The boiler body 2 includes an upper header 3, a lower header 4, and a plurality of water tubes (heat transfer tubes) 5 and 6 arranged to form a cylindrical shape to connect the upper header 3 to the lower header 4.

The upper header 3 and the lower header 4 are arranged at a vertical distance in parallel to each other. Each of the upper header 3 and the lower header 4 forms a hollow annular shape. Further, the upper header 3 and the lower header 4 are arranged horizontally and coaxially.

The plurality of the water tubes 5 are vertically arranged. Upper ends of the water tubes 5 are connected to the upper header 3, and lower ends thereof are connected to the lower header 4. The water tubes 5 are successively arranged in a peripheral direction of the upper header 3 and the lower header 4, thereby constituting a water tube row forming a cylindrical shape. On the other hand, the plurality of the water tubes 6 are also vertically arranged, the upper ends of the water tubes 6 are connected to the upper header 3, and the lower ends of the water tubes 6 are connected to the lower header 4. The water tubes 6 are successively arranged in the peripheral direction of the upper header 3 and the lower header 4 on the outer side of the cylindrically arranged water tubes 5, thereby constituting the water tube row forming the cylindrical shape. In this embodiment, an inner water tube row 7 including the plurality of the water tubes 5 and an outer water tube row 8 including the plurality of the water tubes 6 are concentrically arranged. That is, the outer water tube row 8 is arranged so as to surround the inner water tube row 7. Note that, in the following, the water tubes 5 are referred to as inner water tubes and the water tubes 6 are referred to as outer water tubes.

The inner water tube row 7 is provided with, except for a predetermined region at a lower end thereof, inner longitudinal fins 9 such that gaps between the adjacent inner water tubes 5 are closed. That is, the gaps between the adjacent inner water tubes 5 are closed by the inner longitudinal fins 9 except for the predetermined region at the lower end thereof. In a portion of the inner water tube row 7, where the inner longitudinal fins 9 are not provided, the gaps between the adjacent inner water tubes 5 remain. The gaps constitute communication portions (hereinafter, referred to as inner row communication portions) 10 for establishing communication between spaces on the inner side and the outer side of the inner water tube row 7.

The outer water tube row 8 is provided with, except for a predetermined region at the upper end thereof, outer longitudinal fins 11 such that gaps between the adjacent outer water tubes 6 are closed. That is, the gaps between the outer water tubes 6 are closed by the outer longitudinal fins 11 except for the predetermined region at the upper end thereof. In a portion of the outer water tube row 8, where the outer longitudinal fins 11 are not provided, gaps between the adjacent outer water tubes 6 remain. The gaps constitute communication portions (hereinafter, referred to as outer row communication portions) 12 for establishing communication between spaces on the inner side and the outer side of the outer water tube row 8.

Meanwhile, according to needs, each of the inner water tubes 5 may be further provided with an inner lateral fin (not shown) protruding from the outer peripheral surface thereof. A plurality of inner lateral fins may be provided to each of the inner water tubes 5 at vertical intervals. Further, each of the inner lateral fins normally protrudes in a flange-like shape in a radially outward direction of each of the inner water tubes 5. Similarly, according to needs, each of the outer water tubes 6 may be further provided with an outer lateral fin (not shown) protruding from the outer peripheral surface thereof. A plurality of outer lateral fins may be provided to each of the outer water tubes 6 at vertical intervals. Further, each of the outer lateral fins normally protrudes in a flange-like shape in a radially outward direction of each of the outer water tubes 6. In this case, each of the lateral fins is inclined at a predetermined angle with respect to a horizontal direction, thereby making it possible to generate swirl flow of the combustion gas. Presence/absence of installation of the lateral fin, an installation region and an installation position thereof, the number of lateral fins to be installed, a shape and a size, and the like are appropriately set.

Further, between the upper header 3 and the lower header 4, a boiler body cover 13 of a cylindrical shape is provided so as to surround the outer water tube row 8. An upper end of the boiler cover 13 and the upper header 3 are hermetically sealed. A lower end of the boiler cover 13 and the lower header 4 are also hermetically sealed. To an upper portion of a peripheral wall of the boiler body cover 13, a flue 14 is connected.

A lower surface of the upper header 3 is provided with a fireproof material 15 covering connection portions between the upper header 3 and the inner water tubes 5 and connection portions between the upper header 3 and the outer water tubes 6. An upper surface of the lower header 4 is also provided with another fireproof material 15 covering connection portions with respect to the inner water tubes 5 and connection portions between the lower header 4 and the outer water tubes 6. The fireproof material 15 on the lower header 4 side is provided so as to also close a central portion of the lower header 4. A central portion of the fireproof material 15 on the lower header 4 side has a recess of a columnar shape or a truncated cone shape formed therein.

Meanwhile, in the illustrated example, a lower end of each of the inner water tubes 5 is formed with a small diameter portion 16 having a diameter smaller than that of the other portion. The small diameter portions 16 are provided so as to ensure a predetermined flow rate of the combustion gas passing through the inner row communication portions 10. Accordingly, in a case where, even without the small diameter portions 16, the predetermined flow rate of the combustion gas passing through the inner row communication portions 10 can be ensured, the small diameter portions 16 are not necessary. A size of each of the inner row communication portions 10 depends on the gap between the adjacent inner water tubes 5 and a position of the lower end of the inner longitudinal fin 9 in a height direction thereof. Accordingly, instead of providing the small diameter portions 16, those dimensions may be adjusted. Note that, in the illustrated example, the small diameter portion 16 is not formed on the upper end of each of the outer water tubes 6. However, similarly to the inner water tubes 5, the small diameter portions 16 may be formed thereon.

In a central portion of the upper header 3, there is provided a burner 17 for generating flame downwardly. The burner 17 is supplied with a fuel and a combustion air. By operating the burner 17, combustion of the fuel is performed in the boiler body 2. In this case, an inside of the inner water tube row 7 functions as a combustion chamber 18.

The combustion gas generated by the combustion of the fuel in the combustion chamber 18 is delivered to a combustion gas flow path 19 between the inner water tube row 7 and the outer water tube row 8 through the inner row communication portions 10. The combustion gas is delivered to a space 20 between the outer water tube row 8 and the boiler body cover 13 through the outer row communication portions 12. The combustion gas is then discharged as an exhaust gas to the outside through the flue 14 connected to the boiler body cover 13. In the meantime, the combustion gas undergoes heat exchange with water in the inner water tubes 5 and water in the outer water tubes 6. As a result, the water in the water tubes is heated. The heated water can be taken out from the upper header 3 in a form of steam. The steam which is taken out is sent to steam using equipment (not shown) through a water separator (not shown) or the like.

Between the outer water tube row 8 and the boiler body cover 13, a space 20 is defined to have a cylindrical form. The space 20 is charged with a heat insulating material 21 along an arrangement direction of the plurality of the outer water tube 6 constituting the outer water tube row 8 and in a region extending to a predetermined height from an upper surface of the fireproof material 15 on the lower header 4 side. The heat insulating material 21 may be of any type such as one made of ceramic fibers or rock wool. A reason for providing the heat insulating material 21 is as follows.

Figure 2:
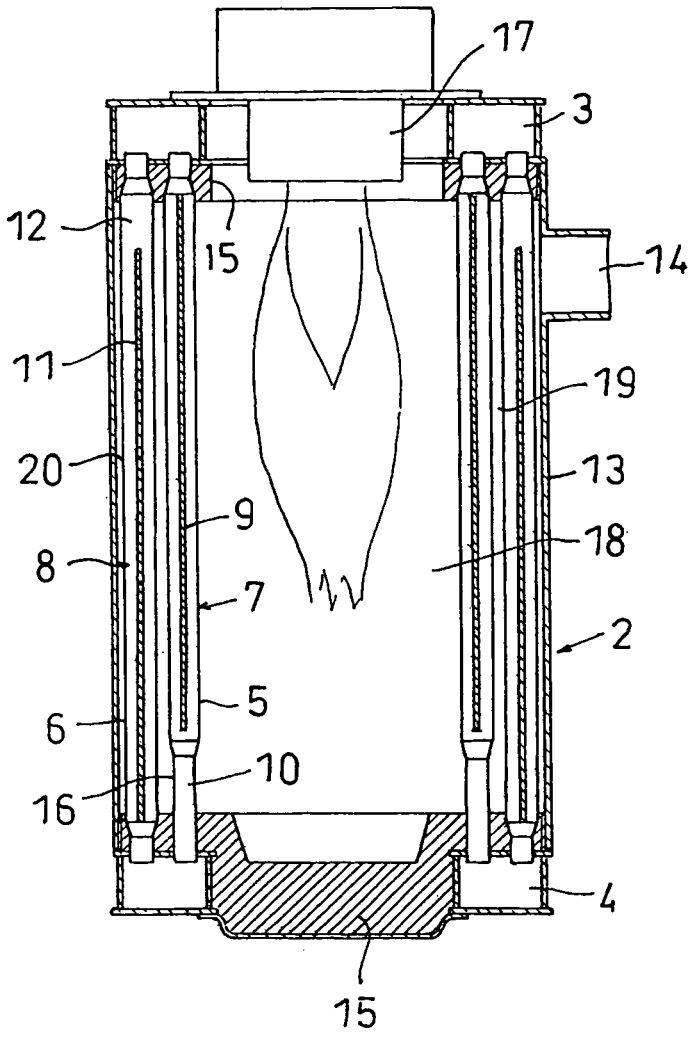
FIG. 2 shows a state where the boiler of FIG. 1 is not charged with a heat insulation material.

FIG. 2 is a view showing a state where the heat insulating material 21 is not charged in the boiler body 2 of FIG. 1. When the boiler 1 is used in the state shown in FIG. 2, the combustion gas passes through the combustion gas flow path 19 to be introduced from the combustion chamber 18 to the space 20 substantially uniformly over an entire periphery thereof without being biased. In this case, the water tubes 5 and 6 have a temperature close to saturation temperature (for example, 150 to 180° C.) of water or steam at a pressure inside thereof. The boiler body cover 13 is exposed to the combustion gas at higher temperature than that of the water tubes 5 and 6, so a temperature of the boiler body cover 13 becomes close to the exhaust gas temperature (for example, 350° C.). Accordingly, in the boiler body cover 13, there is caused a difference in thermal expansion amounts due to a temperature difference between the boiler body cover 13 and the water tubes 5 and 6, resulting in the thermal stress acting thereon.

In order to relax the thermal stress, in this embodiment, as shown in FIG. 1, in the space 20 between the outer water tube row 8 and the boiler body cover 13, the heat insulating material 21 is charged. As a result, a temperature of the boiler body cover 13 adjacent to the region in which the heat insulating material 21 is not charged (that is, high temperature portion) is higher than the heat transfer tube temperature (almost equal to the saturation temperature of the heat medium at the pressure in the boiler body, and lower than the combustion gas temperature) because the boiler body cover 13 is heated by the combustion gas. However, the temperature of the boiler body cover 13 adjacent to a region where the heat insulating material 21 is provided (that is, low temperature portion) is lower than the heat transfer tube temperature because the boiler body cover 13 is not directly exposed to the combustion gas and heat transfer from the heat transfer tube is suppressed. In this case, a thickness and a height of the heat insulating material 21 is adjusted so that the thermal expansion amount of the boiler body cover 13 as a whole including the high temperature portion and the low temperature portion is about the same as the thermal expansion amount of the water tubes 5 and 6. As a result, the thermal stress caused in the boiler body cover 13 can be relaxed.

In the boiler 1 according to this embodiment, the space 20 on the inner side of the boiler body cover 13 for sealing in the exhaust gas is charged with the heat insulating material 21 so as to extend along the arrangement direction of the plurality of the outer water tubes 6 constituting the outer water tube row 8 and in the region extending to a predetermined height from an upper surface of the fireproof material 15 on the lower header 4 side. Accordingly, in the region in which the heat insulating material 21 is charged, the exhaust gas does not flow. As a result, a temperature difference is caused between an upper portion and a lower portion of the boiler body cover 13, and the temperature in the upper portion of the boiler body cover 13 is higher than that of the water tubes 5 and 6, whereas the temperature in the lower portion of the boiler body cover 13 is lower than that of the water tubes 5 and 6. Accordingly, elongation in boiler body cover 13 is about the same elongation of the water tubes 5 and 6. As a result, the thermal stress caused in the boiler body cover 13 can be relaxed.

Further, in this embodiment, the heat insulating material 21 is charged so as to completely fill the space 20 between the outer water tube row 8 and the boiler body cover 13. Accordingly, the low temperature portion of the boiler body cover 13 is retained at still lower temperature than the temperature of the outer water tube row 8 having lower temperature than that of the combustion gas. As a result, the thickness of the heat insulating material 21 can be reduced.

In this embodiment, the inner longitudinal fins 9 are provided to the inner water tube row 7 so as to close the gaps between the adjacent inner water tubes 5. The outer longitudinal fins 11 are provided to the outer water tube row 8 so as to close the gaps between the adjacent outer water tubes 6. As a result, flow of the combustion gas into the gaps between the inner water tubes 5 and into the gaps between the outer water tubes 6 is enabled, thereby preventing the gaps from being dead spaces. Further, by the inner longitudinal fins 9 and the outer longitudinal fins 11, heat conduction efficiency from the combustion gas to the inner water tubes 5 and the outer water tubes 6 can be enhanced. In addition, after the combustion gas is radially discharged from the entire periphery of the outer water tube row 8, the exhaust gas is introduced to the flue 14 through the space 20 between the outer water tube row 8 and the boiler body cover 13. Accordingly, uniform flow of the exhaust gas over an entire area in the peripheral direction of the outer water tube row 8 can be realized.

Embodiment 2

Figure 3:
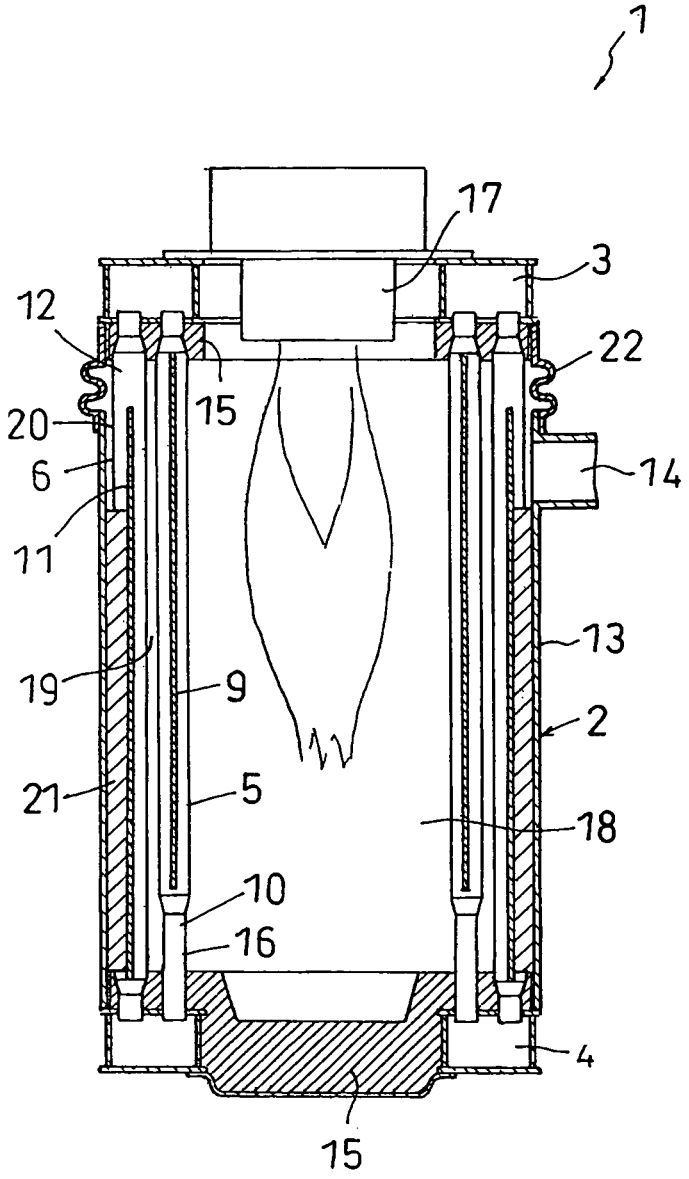
FIG. 3 is a schematic cross sectional view showing a boiler according to Embodiment 2 of the present invention.

FIG. 3 is the schematic longitudinal sectional view showing a boiler according to Embodiment 2 of the present invention. The boiler according to Embodiment 2 is basically the same as the boiler 1 of the above Embodiment 1. In the following, a description will be centered on a difference therebetween, and corresponding portions are denoted by the same reference numerals.

In the above-mentioned Embodiment 1, the boiler body cover 13 has just a cylindrical shape. However, in Embodiment 2 of the present invention, the boiler body cover 13 has an expansion portion 22 of a bellows shape, which is expandable in an axial direction of the boiler body cover 13. The expansion portion 22 is provided to the high temperature portion in which the heat insulating material 21 is not charged. With the provision of the expansion portion 22 to the boiler body cover 13, even when there is caused a difference between the thermal expansion amount of the boiler body cover 13 and the thermal expansion amount of the water tubes 5 and 6, the expansion portion 22 expands and contracts to absorb the difference. As a result, the thermal stress caused in the boiler body cover 13 can be relaxed more reliably. The other structures are the same as those of the above-mentioned Embodiment 1, so a description thereof will be omitted.

Embodiment 3

Figure 4:
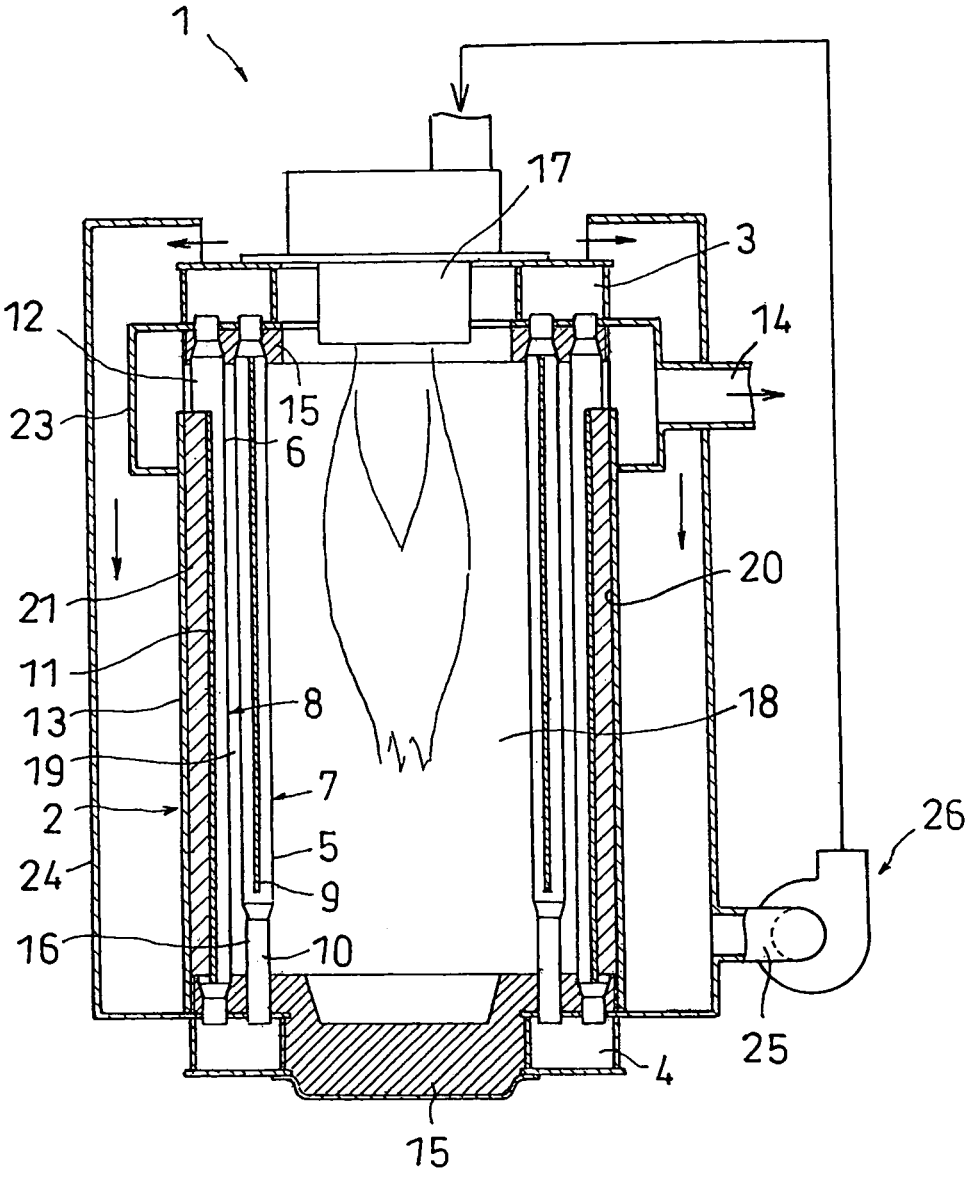
FIG. 4 is a schematic cross sectional view showing a boiler according to Embodiment 3 of the present invention.

FIG. 4 is the schematic longitudinal sectional view showing a boiler according to Embodiment 3 of the present invention. The boiler according to Embodiment 3 is basically the same as the boiler 1 of the above Embodiment 1. In the following, a description will be centered on a difference therebetween, and corresponding portions are denoted by the same reference numerals.

In the above-mentioned Embodiment 1, the boiler body cover 13 has just a cylindrical shape. However, in Embodiment 3 of the present invention, the boiler body cover 13 has a large diameter portion 23. The large diameter portion 23 is provided to the high temperature portion side in which the heat insulating material 21 is not charged. The large diameter portion 23 receives the exhaust gas radially discharged from the upper portion of the outer water tube row 8 and ensures uniform flow of the exhaust gas over an entire region in the peripheral direction thereof. Further, the large diameter portion 23 reduces pressure loss until the exhaust gas from the outer row communication portion 12 is discharged to the flue 14. The boiler 1 of Embodiment 3 is provided with a cylindrical casing 24 which surrounds the boiler body cover 13. A cylindrical space between the boiler body cover 13 and the casing 24 is opened at an upper end thereof and is closed at a lower end thereof. A lower portion of a peripheral side wall of the casing 24 is connected to a suction port of a blower 26 through a communication path 25. The blower 26 serves to send the combustion air to the burner 17.

Accordingly, the outside air is sent as the combustion air from a position surrounding the burner 17 on the upper surface of the upper header 3 through a space between the boiler body cover 13 and the casing 24 to the combustion chamber 18. By the suction air into the blower 26, the boiler body cover 13 (in particular, large diameter portion 23 constituting high temperature portion thereof) can be cooled. Note that the boiler body cover 13 may be cooled by air ejected from the blower 26 instead of air sucked into the blower 26. Specifically, air ejected from the blower 26 may be sent as combustion air through the space between the boiler body cover 13 and the casing 24 to the combustion chamber 18.

In the case of the boiler 1 according to Embodiment 3 of the present invention, the boiler body cover 13 can be actively cooled by using supply air of the boiler 1. As a result, the thickness of the heat insulating material 21 can be minimized.

Embodiment 4

Figure 5:
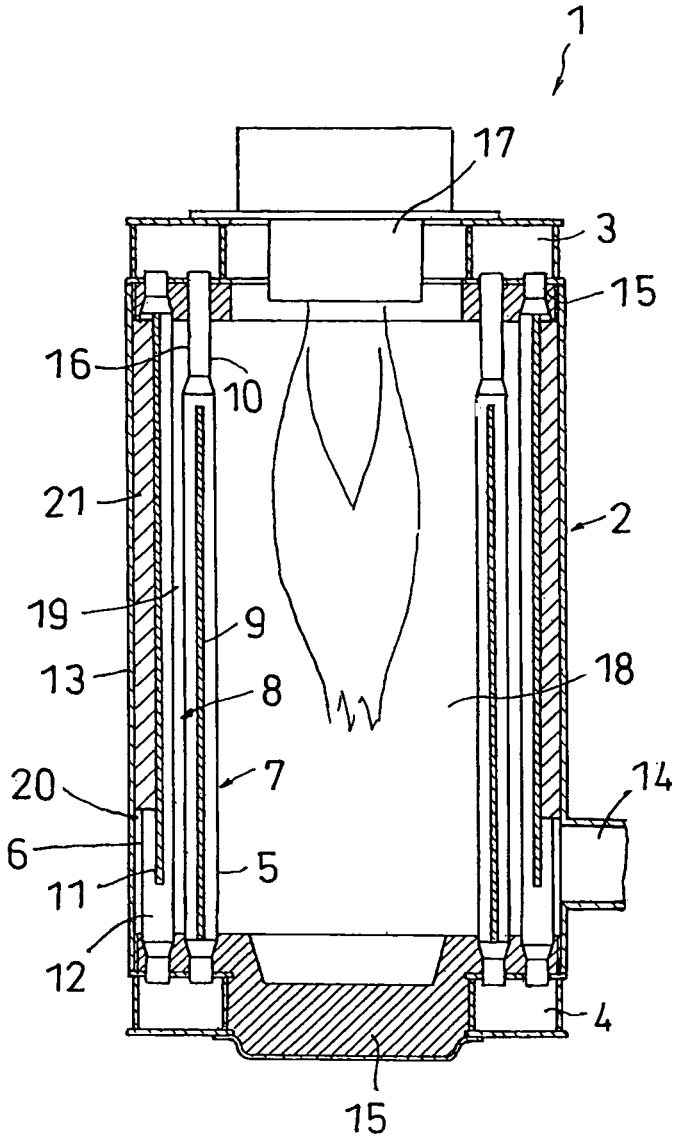
FIG. 5 is a schematic cross sectional view showing a boiler according to Embodiment 4 of the present invention.

FIG. 5 is the schematic longitudinal sectional view showing a boiler according to Embodiment 4 of the present invention. The boiler according to Embodiment 4 is basically the same as the boiler 1 of the above Embodiment 1. In the following, a description will be centered on a difference therebetween, and corresponding portions are denoted by the same reference numerals.

The boiler 1 of the above Embodiment 1, the inner row communication portions 10 are provided to the lower end of the inner water tube row 7, and the outer row communication portions 16 are provided to the upper end of the outer water tube row 12. With this structure, the combustion gas from the burner 17 on an upper portion of the boiler body 2 flows through the inner row communication portions 10 at the lower end of the inner water tube row 7 into the combustion gas flow path 19 and is discharged to the boiler body cover 13 from the outer row communication portions 12 at the upper end of the outer water tube row 8. On the other hand, the boiler 1 according to Embodiment 4, the inner row communication portions 10 are provided to the upper end of the inner water tube row 7, and the outer row communication portions 12 are provided to the lower end of the outer water tube row 8. With this structure, the combustion gas from the burner 17 in the upper portion of the boiler body 2 flows from the inner row communication portions 10 at the upper end of the inner water tube row 7 into the combustion gas flow path 19 and is discharged from the outer row communication portions 12 at the lower end of the outer water tube row 8 to the boiler body cover 13.

In the case of Embodiment 4 of the present invention, the heat insulating material 21 is charged in the upper region of the space 20 between the outer water tube row 8 and the boiler body cover 13. The other structures are the same as those of the above-mentioned Embodiment 1, so a description thereof will be omitted.

The boiler 1 of the present invention is not limited to the above embodiments and can be modified. For example, in the above embodiments, while the inner water tube row 7 and the outer water tube row 8 are provided, the number of water tube rows can be increased or decreased as appropriate. Further, in the above embodiments, the lower portion of the boiler body 2 is closed and the burner 17 is provided to the upper portion of the boiler body 2. Conversely, there may be provided a structure in which the upper portion of the boiler body 2 is closed and the burner 17 is provided to the lower portion of the boiler body 2.

Further, in the above embodiments, the description is made of the example in which the boiler of the present invention is applied to a steam boiler. However, the boiler of the present invention may be applied to a hot water boiler or a heat medium boiler. Further, in the embodiments, instead of providing the burner 17, by providing a structure with which an exhaust gas is introduced into the inner side of the inner water tube row 7, the boiler of the present invention may be applied to a waste heat boiler or an exhaust gas boiler.

Further, the structures according to the above-mentioned embodiments can be combined with each other. For example, the expansion portion 22 of Embodiment 2 may be provided to the large diameter portion 23 of Embodiment 3 or the like. Further, the boiler 1 of Embodiment 4 may be added with the expansion portion 22 of Embodiment 2 or a structure for cooling the boiler body cover 13 using supply air of the boiler 1 according to Embodiment 3.

What is claimed is:

1. A boiler comprising:

a plurality of heat transfer tubes arranged to form a cylindrical shape between an upper header and a lower header to constitute a heat transfer tube row;

a longitudinal fin connected to the heat transfer tube row;

a boiler body cover of a cylindrical shape provided between the upper header and the lower header so as to surround the heat transfer tube row;

a flue connected to the boiler body cover having an opening; and a heat insulating material provided to a predetermined region of a space between the heat transfer tube row and the boiler body cover and extending a predetermined length in a vertical direction that is less than the length of the heat transfer tubes, and is less than the length of the longitudinal fin connected to the heat transfer tube row.

2. A boiler comprising:

a plurality of inner heat transfer tubes arranged to form a cylindrical shape between an upper header and a lower header to constitute an inner heat transfer tube row;

a plurality of outer heat transfer tubes arranged to form a cylindrical shape between the upper header and the lower header so as to surround the inner heat transfer tube row to constitute an outer heat transfer tube row;

a flue connected to the boiler body cover having an opening;

a plurality of inner longitudinal fins provided to close gaps between the adjacent plurality of inner heat transfer tubes except at one end in a vertical direction of the inner heat transfer tube row; a plurality of outer longitudinal fins provided to close gaps between the adjacent plurality of outer heat transfer tubes except at another end in a vertical direction of the outer heat transfer tube row;

a longitudinal fin connected to the outer heat transfer tube row;

a boiler body cover of a cylindrical shape provided between the upper header and the lower header so as to surround the outer heat transfer tube; and a heat insulating material provided to a predetermined region of a space between the outer heat transfer tube row and the boiler body cover, and extending a predetermined length in a vertical direction that is less than the length of the heat transfer tubes, and is less than the length of the longitudinal fins connected to the outer heat transfer tube row.

3. A boiler according to claim 2, wherein the heat insulating material extends from one of the upper header or lower header end in the vertical direction of the inner heat transfer tube row and the outer heat transfer tube row.

4. A boiler according to claim 2 or 3, wherein:

the boiler body cover has a large diameter portion at said another end in the vertical direction of the inner heat transfer tube row and the outer heat transfer tube row;

the boiler further comprises a casing surrounding the boiler body cover; and a space between the boiler body cover and the casing allows combustion air to pass therethrough to be sent to a combustion chamber on an inner side of the inner heat transfer tube row.

5. A boiler according to any one of claims 1 to 3; wherein the boiler body cover is provided with an expansion portion which is expandable in a vertical direction.

6. A boiler according to claim 4 wherein the boiler body cover is provided with an expansion portion which is expandable in a vertical direction.

* * * * *